US007971516B2

(12) United States Patent
Hogan

(10) Patent No.: US 7,971,516 B2
(45) Date of Patent: Jul. 5, 2011

(54) PORTABLE BALLISTIC SHIELD

(76) Inventor: Guy Hogan, Keyport, NJ (US)

( * ) Notice: Subject to any disclaimer, the term of this patent is extended or adjusted under 35 U.S.C. 154(b) by 339 days.

(21) Appl. No.: 12/400,741

(22) Filed: Mar. 9, 2009

(65) Prior Publication Data

US 2011/0005380 A1 Jan. 13, 2011

(51) Int. Cl.
*F41H 7/00* (2006.01)

(52) U.S. Cl. ..... 89/36.07; 89/36.05; 109/49.5; 224/628; 224/907

(58) Field of Classification Search ..... 89/36.01, 89/36.05, 36.06, 36.07; 109/49.5; 224/261, 224/628, 907; 2/2.5
See application file for complete search history.

(56) References Cited

U.S. PATENT DOCUMENTS 2,921,317 A * 1/1960 Tifft ..... 2/2.5
3,370,302 A * 2/1968 Karlyn ..... 2/2.5
4,830,245 A 5/1989 Arakaki
6,161,738 A 12/2000 Norris
6,389,949 B1 * 5/2002 Carreira ..... 89/36.07
6,419,132 B1 * 7/2002 Reed et al. ..... 224/153
6,685,071 B2 2/2004 Prather
6,691,601 B2 2/2004 Cohen et al.
6,807,890 B1 * 10/2004 Fuqua ..... 89/36.02
7,284,470 B2 10/2007 Huber et al.
7,441,278 B2 * 10/2008 Blakeley ..... 2/2.5
2005/0217472 A1 * 10/2005 Baker ..... 89/36.06
2007/0295772 A1 12/2007 Woodmansee
2010/0083820 A1 * 4/2010 Doyner et al. ..... 89/36.02

* cited by examiner

*Primary Examiner* — J. Woodrow Eldred
*Assistant Examiner* — Gabriel J Klein
(74) *Attorney, Agent, or Firm* — Michael R. Kahn

(57) ABSTRACT

A portable ballistic shield is disclosed. The portable ballistic shield is contoured to conform to an individual's body and may be integrated with a rucksack and frame to provide protection to the user's back and torso while still allowing the user substantially unobstructed access to all parts of the rucksack. The portable ballistic shield may also provide rigidity for the rucksack, eliminating the need for a rucksack frame. The portable ballistic shield may also comprise a shape allowing for the user to concurrently utilize an assault rifle or other firearm. During times of hostility, the user may deploy the shield from the rucksack in a minimal amount of time in order to protect the user from oncoming gunfire or shrapnel.

18 Claims, 15 Drawing Sheets

PORTABLE BALLISTIC SHIELD

FIELD OF THE INVENTION

The present invention relates to personal shields for protection against bullets and projectile fragments.

BACKGROUND

There are many situations where a soldier or law enforcement official may be placed in a dangerous environment. Militia groups, rioters, terrorists, and organized crime members are often well-armed. Therefore, there continues to be a need for improvements in the area of protective armor, in the interest of protecting the lives of soldiers, police, and other law enforcement officials.

SUMMARY OF THE INVENTION

Embodiments of the present invention provide a portable ballistic shield, which is contoured to conform to an individual's body. The portable ballistic shield may be integrated with a rucksack and frame to provide protection to the user's back and torso while still allowing the user substantially unobstructed access to all parts of the rucksack. The portable ballistic shield may also provide rigidity for the rucksack, eliminating the need for a rucksack frame, thereby reducing overall weight of a soldier's pack. The portable ballistic shield may also comprise a shape allowing for the user to concurrently utilize an assault rifle or other firearm. During times of hostility, the user may deploy the shield from the rucksack in a minimal amount of time in order to protect the user from oncoming gunfire or shrapnel.

The portable ballistic shield has a shape that provides for ease of carrying on a user's back, either directly, or attached to a rucksack frame. The shape also provides for ambidextrous usage, and allows for supporting a firearm such as an assault rifle or a handgun in the cutaway section of the shield. The shape of the shield also facilitates layering of two ballistic shields to provide additional protection when stronger firepower is encountered. The shield is able to be quickly and easily inserted and removed from the rucksack frame. Because the shield is stored in between the rucksack and the frame, it does not occupy any space within the rucksack, leaving room for other needed supplies. In one embodiment, the shield has a length of about 21 inches, and a width of about 16 inches, to provide protection for a torso-sized area. The portable ballistic shield can be used in a variety of applications, such as road blocks, guard duties, and light armoring of a vehicle. Furthermore, unlike body armor, the use of a ballistic shield provides more body coverage when directed towards an enemy.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting.

In the drawings accompanying the description that follows, in some cases both reference numerals and legends (labels, text descriptions) may be used to identify elements. If legends are provided, they are intended merely as an aid to the reader, and should not in any way be interpreted as limiting.

DETAILED DESCRIPTION

Figure 1:
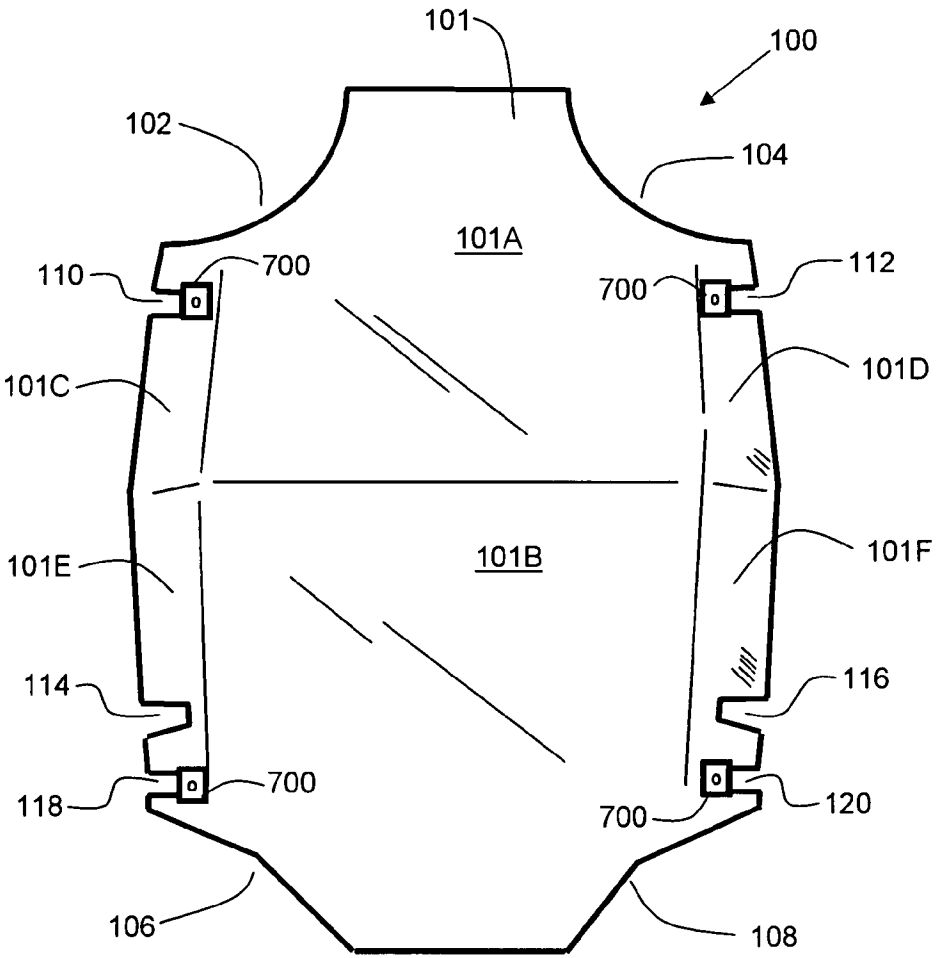
FIG. 1 shows a front view of an embodiment of a portable ballistic shield.

FIG. 1 shows a front view of an embodiment of a portable ballistic shield 100 in accordance with the present invention. Shield 100 has an inner side that faces a user, and an outer side that faces away from a user. FIG. 1 shows the outer side of the shield 100. Shield 100 comprises ballistic panel 101, which is comprised of a ballistic material that is capable of providing protection against bullets and projectile fragments. The portable ballistic shield 100 may comprise any suitable ballistic material. In one embodiment, the ballistic shield 100 is comprised of DYNEEMA UD, produced by DSM DYNEEMA of the Netherlands.

Ballistic panel 101 is of a generally rectangular shape with two opposed upper cutaways, 102 and 104. The cutaways (102, 104) are used to allow a user to peer out from behind the shield, and may also be used to steady a weapon. In one embodiment, cutaways 102 and 104 have a curved profile.

Ballistic panel 101 may also comprise two opposed lower cutaways 106 and 108, which serve to increase the portability of the ballistic shield 100. The ballistic panel 101 is comprised of a single piece of ballistic material that is formed to have a plurality of faces (101A-101F) on the front. The faces join each other at angles, and serve to provide additional deflection capabilities.

For maintaining integrity, it is desirable to avoid making any holes in the ballistic panel 101. Therefore, in order to attach straps to the ballistic shield 100, fasteners 700 are affixed to ballistic panel 101, and serve to secure carry straps to the ballistic panel 101. A plurality of cutouts (110, 112, 118, and 120) are formed in the ballistic panel 101, to accommodate straps used for carrying and maneuvering the ballistic shield 100. Cutouts 114 and 116 are used to receive straps from a rucksack, which secure the ballistic shield 100 to a rucksack during transport.

Figure 2:
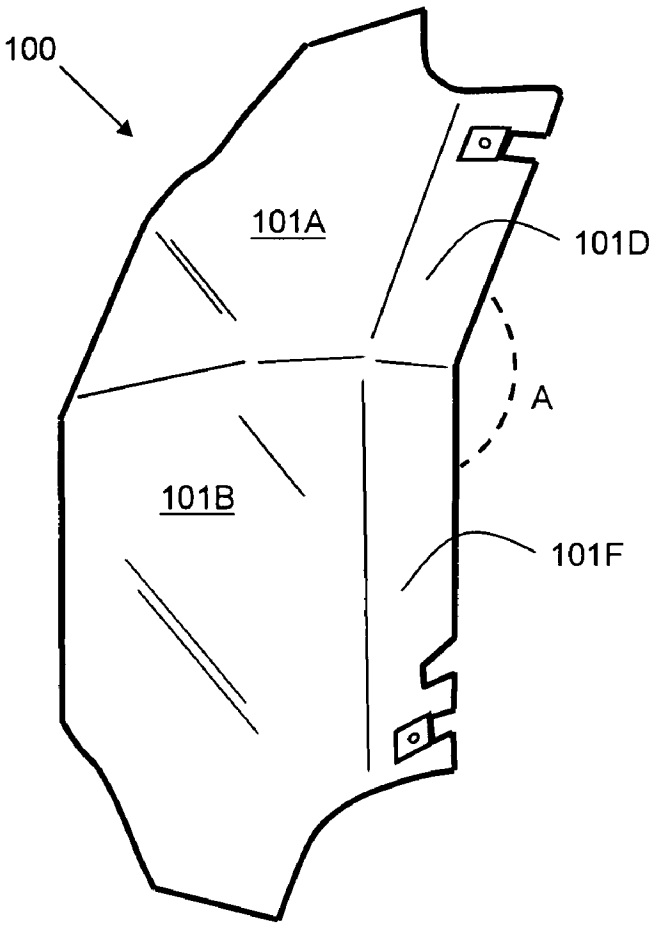
FIG. 2 shows a perspective view of the embodiment of FIG. 1

FIG. 2 shows a perspective view of the ballistic shield 100. Faces 101A, 101B, 101D, and 101F are visible in this view. The upper portion of the ballistic shield (faces 101C, 101A, and 101D) meets the lower portion of the ballistic shield (faces 101D, 101B, and 101F) at an angle A. In one embodiment, angle A ranges from about 150 degrees to about 175 degrees.

Figure 3:
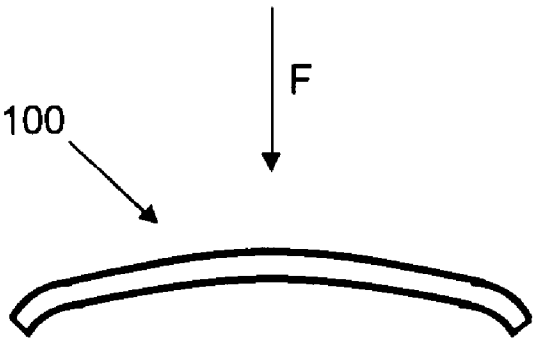
FIG. 3 shows a top-down view of the embodiment of FIG. 1

FIG. 3 shows a top-down view of the ballistic shield 100, where the arrow F is pointing to the front of the ballistic shield 100. In this view, the slight curve of the ballistic shield 100 is visible. The curved shape aids in deflecting projectiles.

Figure 4:
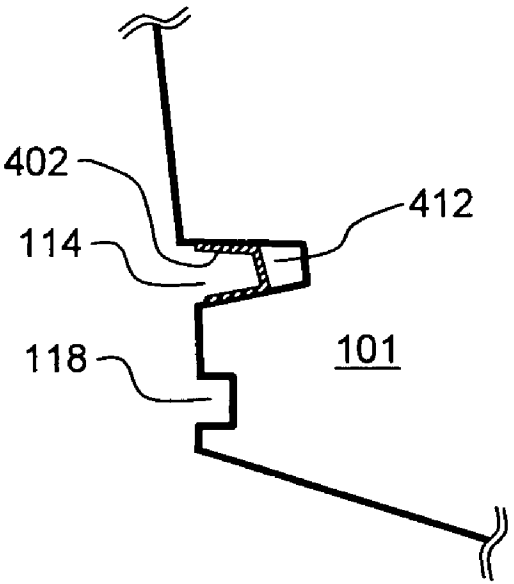
FIG. 4 shows a detailed view of strap fasteners on an embodiment of a portable ballistic shield.

FIG. 4 shows a detailed view of strap fasteners on an embodiment of a portable ballistic shield. In this detailed view of ballistic panel 101, cutouts 114 and 118 are visible. Cutout 118 is used to guide the position of a carry strap. Strap brace 402 is affixed at an intermediate position in the cutout 114, thereby creating an opening 412 adapted to receive a strap of a rucksack. During transport, a user places the straps of a rucksack through these openings to secure the ballistic shield to the rucksack. A similar strap brace is used within cutout 116 (see FIG. 1) on the other side of ballistic shield 100. These openings provide a means for securing ballistic panel 101 with straps of a rucksack. In one embodiment, the strap brace 402 is comprised of a lightweight metal such as titanium or aluminum, and held in place via a strong adhesive, such as a quick-setting epoxy. A lightweight composite material may also be used for strap brace 402.

Figure 5:
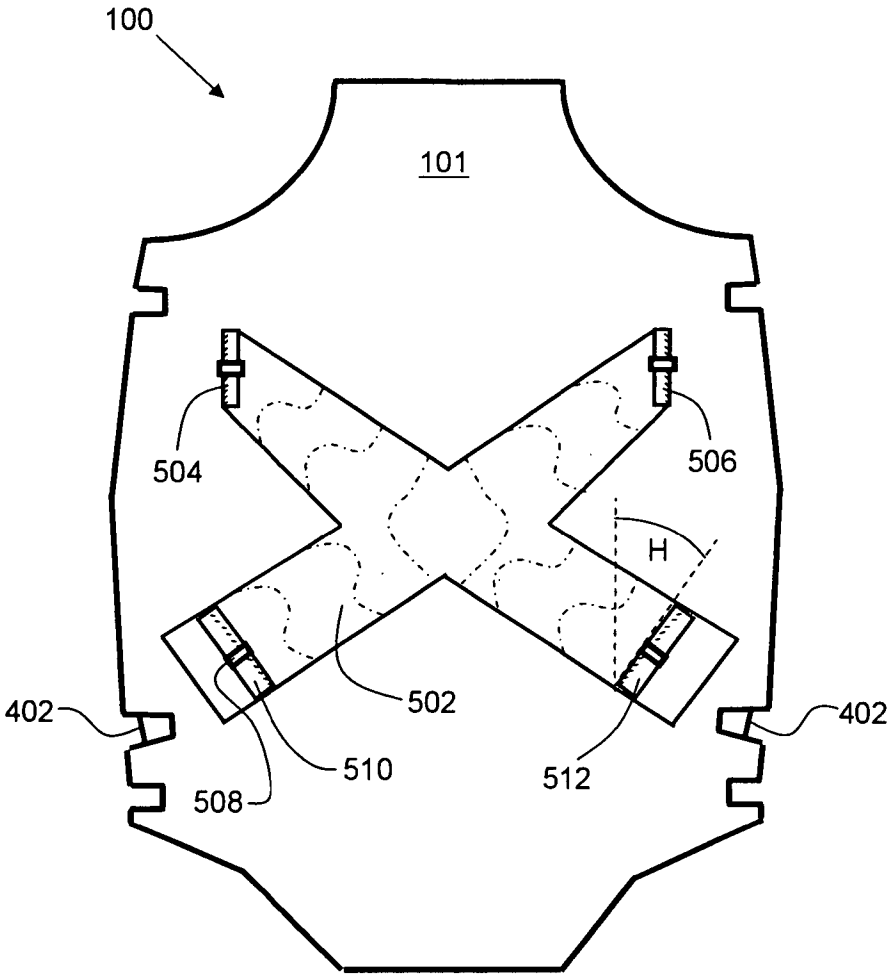
FIG. 5 shows a back view of an embodiment of a portable ballistic shield.

FIG. 5 shows a back view of an embodiment of portable ballistic shield 100. FIG. 5 shows the inner side of the shield 100. In this view, X-shaped cushion 502 is visible. The portable ballistic shield 100 also comprises handles 504 and 506, and arm straps 510 and 512. Handle 504 is mounted in the upper left region of the ballistic shield. Handle 506 is mounted in the upper right region of the ballistic shield. Arm strap 510 is mounted in the lower left region of the ballistic shield. Arm strap 512 is mounted in the lower right region of the ballistic shield. The arm straps are preferably mounted at an angle H with respect to vertical. In one embodiment, angle H ranges from about 20 degrees to about 50 degrees. Handles 504 and 506 may be mounted in a substantially vertical orientation. Alternatively, the handles (504, 506) and arm straps (510, 512) may be mounted to ballistic panel 101 via swivel fasteners to allow a range of angular motion during use. Arm straps (510, 512) and handles (504, 506) may be adjusted via buckle 508 (for clarity, only one buckle is labeled in FIG. 5). This arrangement provides for ambidextrous usage. In the case of a user who shoots a weapon right-handed, the user would preferably place his left arm through arm strap 510, and grip handle 506 with his left hand. The user then can tighten handle 504 to a desired snugness. In the case of a user who shoots a weapon left-handed, the user would preferably place his right arm through arm strap 512, and grip handle 504 with his right hand. In one embodiment, cushion 502 is shaped in a "X" pattern to accommodate both left-hand and right-hand usage, and serves to help absorb shock from a projectile striking the front of ballistic shield 100. It is also possible to have a cushion that covers a larger area, which may be generally square or rectangular, instead of, or in addition to, the X-shaped cushion.

Figure 6A:
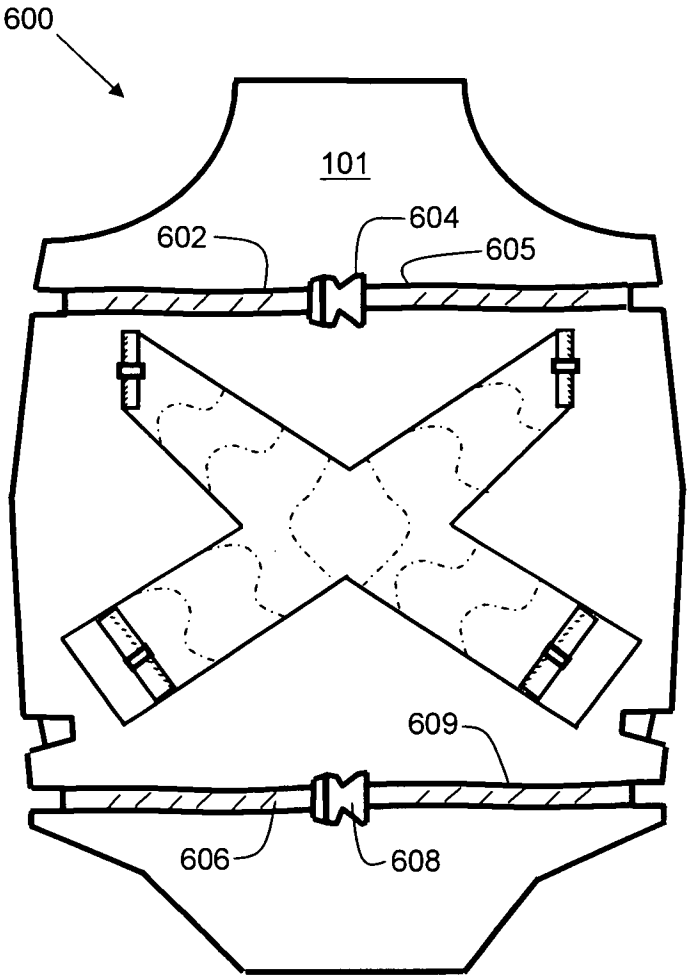
FIGS. 6A and 6B show a back view of an additional embodiment of a portable ballistic shield.
Figure 6B:
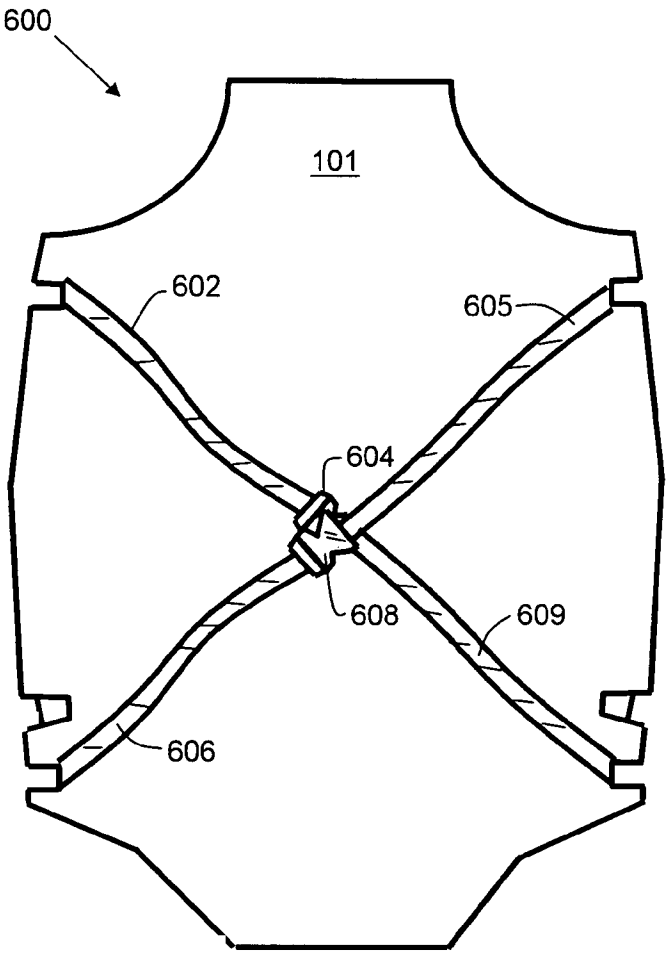

FIGS. 6A and 6B show a back view of an additional embodiment of a portable ballistic shield 600. Ballistic shield 600 is similar to ballistic shield 100, with the addition of upper carry straps 602 and 605, which are fastened together by buckle 604, and the addition of lower carry straps 606 and 609, which are fastened together by buckle 608. In FIG. 6A, these straps are shown in a storage position. However, as shown in FIG. 6B, the buckles 604 and 608 are mated such that the carry straps may be configured in a "cross-strap" configuration, where upper carry strap 602 is fastened to lower carry strap 609, and upper carry strap 605 is fastened to lower carry strap 606. The cross-strap configuration is useful for transporting the ballistic shield 600 on the back of a user. Note that in FIG. 6B, the cushion and handles are not illustrated for the sake of clarity.

Figure 7:
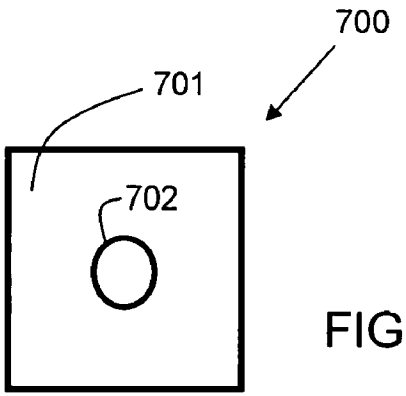
FIG. 7 is a top view of a fastener used on an embodiment of a portable ballistic shield.
Figure 8:
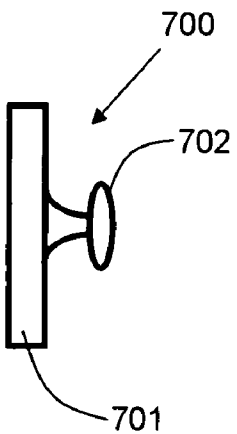
FIG. 8 is a side view of a fastener used on an embodiment of a portable ballistic shield.

FIGS. 7 and 8 are views of a swivel fastener 700 used on an embodiment of a portable ballistic shield. Fastener 700 comprises a base 701, and a peg 702, which is located generally in the midpoint of base 701. FIG. 7 shows a top view of fastener 700, and FIG. 8 shows a side view of fastener 700. Straps mounted with swivel fastener 700 are able to pivot to provide a range of angular motion.

Figure 9:
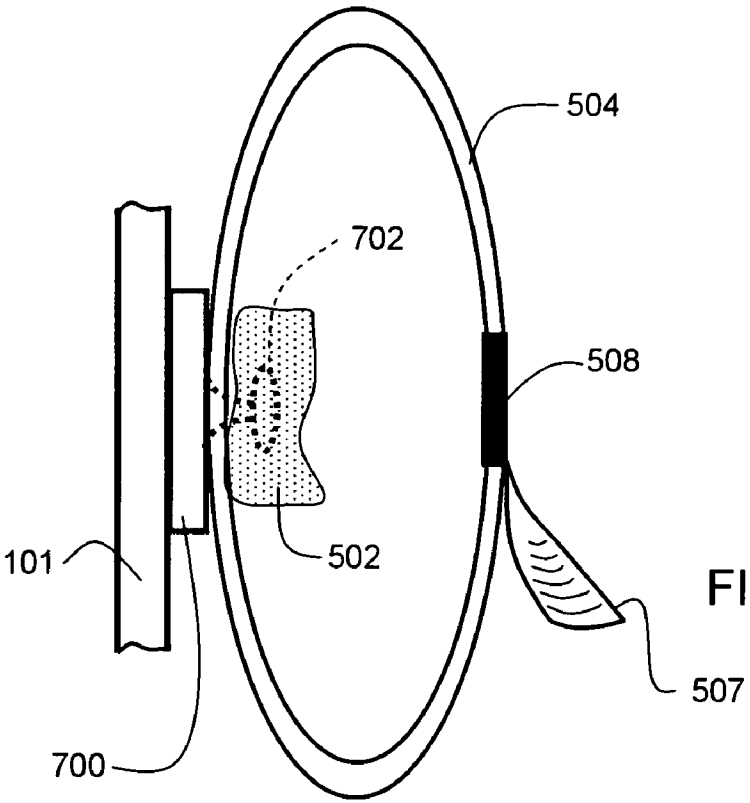
FIG. 9 shows a detailed view of a handle used on an embodiment of a portable ballistic shield.

FIG. 9 shows a detailed view of handle 504. Fastener 700 is affixed to ballistic panel 101. In one embodiment, fastener 700 is affixed to ballistic panel 101 with epoxy, or other suitable adhesive. A portion of cushion 502 is shown, which is attached to peg 702 of fastener 700. Peg 702 traverses handle 504 to secure it in place, while also allowing some movement of handle 504 for comfort. An adjustment mechanism, such as buckle (or other suitable adjustment means) 508 is used to adjust the handle for the appropriate size to accommodate the hand of the user. In one embodiment, the user pulls tab 507 to tighten the handles and arm straps to the desired snugness. Arm straps (see 510 and 512 of FIG. 5) are secured to ballistic panel 101 in a similar manner.

Figure 10:
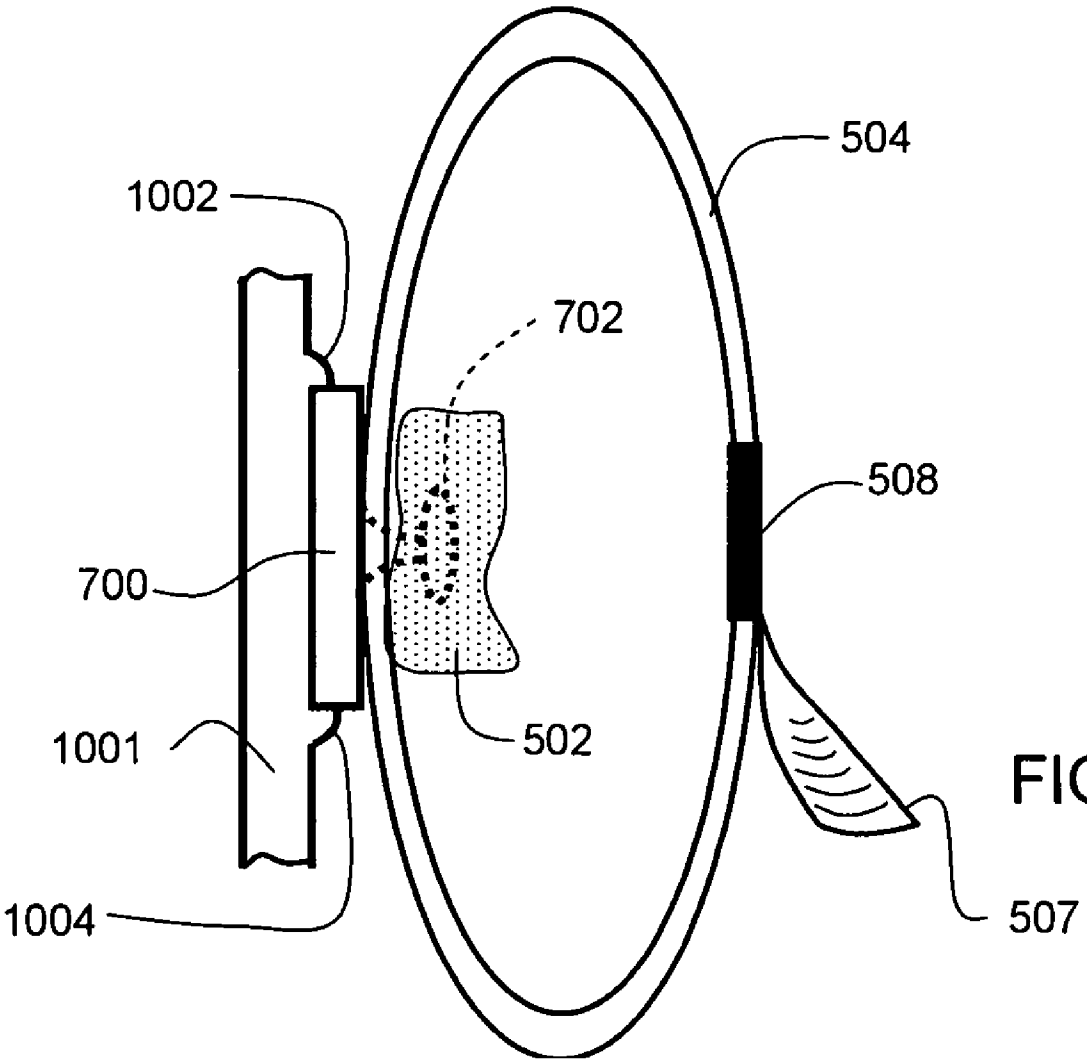
FIG. 10 shows a detailed view of a handle used on an alternative embodiment of a portable ballistic shield.

FIG. 10 shows a detailed view of a handle used on an alternative embodiment of a portable ballistic shield. This embodiment is similar to that described in FIG. 9, with the exception of ballistic panel 1001, which is comprised of guide ridges 1002 and 1004, which serve to properly position fastener 700. Guide ridges 1002 and 1004 may be formed during the manufacture of the ballistic panel 1001 by pressing.

Figure 11:
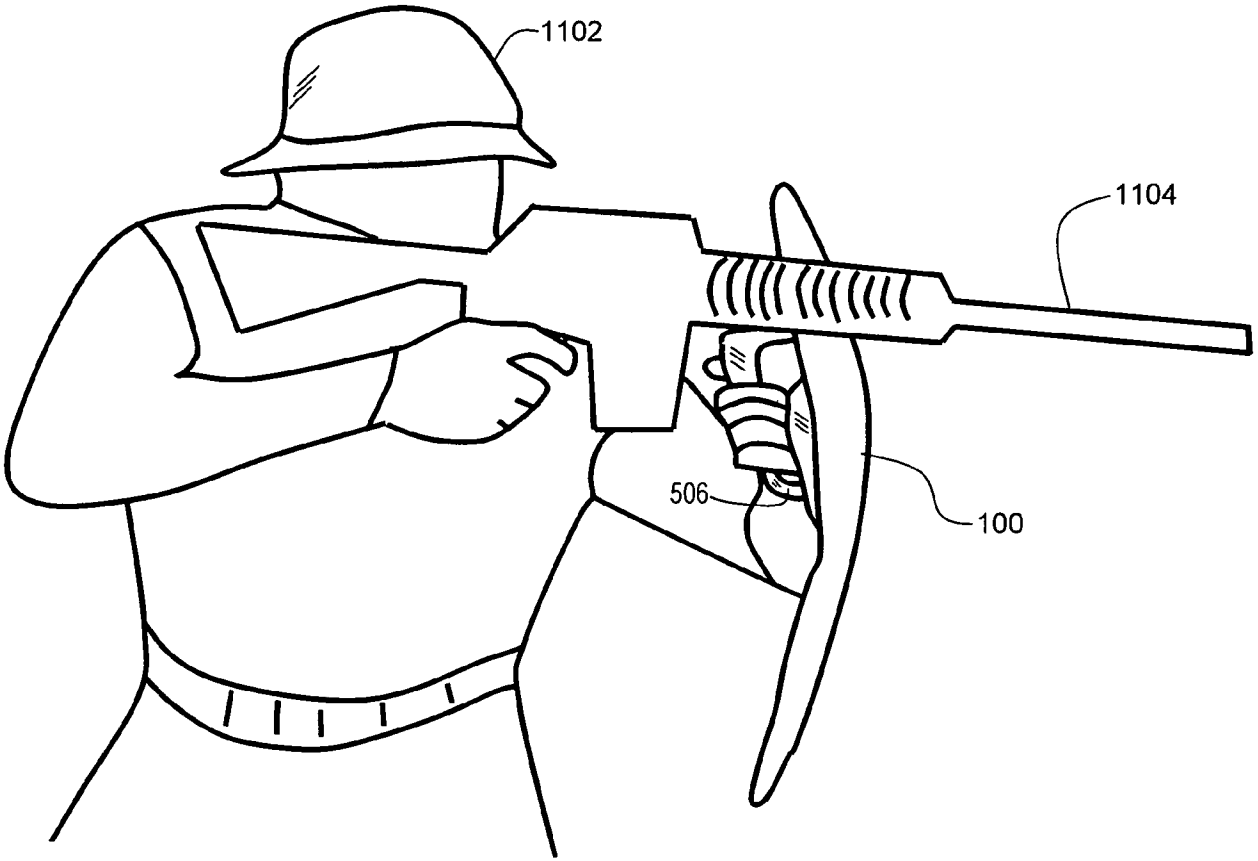
FIG. 11 shows a side view of an embodiment of a portable ballistic shield in use.

FIG. 11 shows a side view of an embodiment of a portable ballistic shield 100 in use. A user 1102, which may typically be a soldier or law enforcement agent, holds his firearm 1104 with his shooting hand (in this illustration, his right hand). The left hand is used to position the ballistic shield as to protect the body of the user 1102 from incoming projectiles. The left arm of user 1102 goes through arm strap 510 (FIG. 5) and the left hand holds handle 506. This technique provides the user with a stable firing position, while still maintaining protection from the ballistic shield 100.

Figure 12:
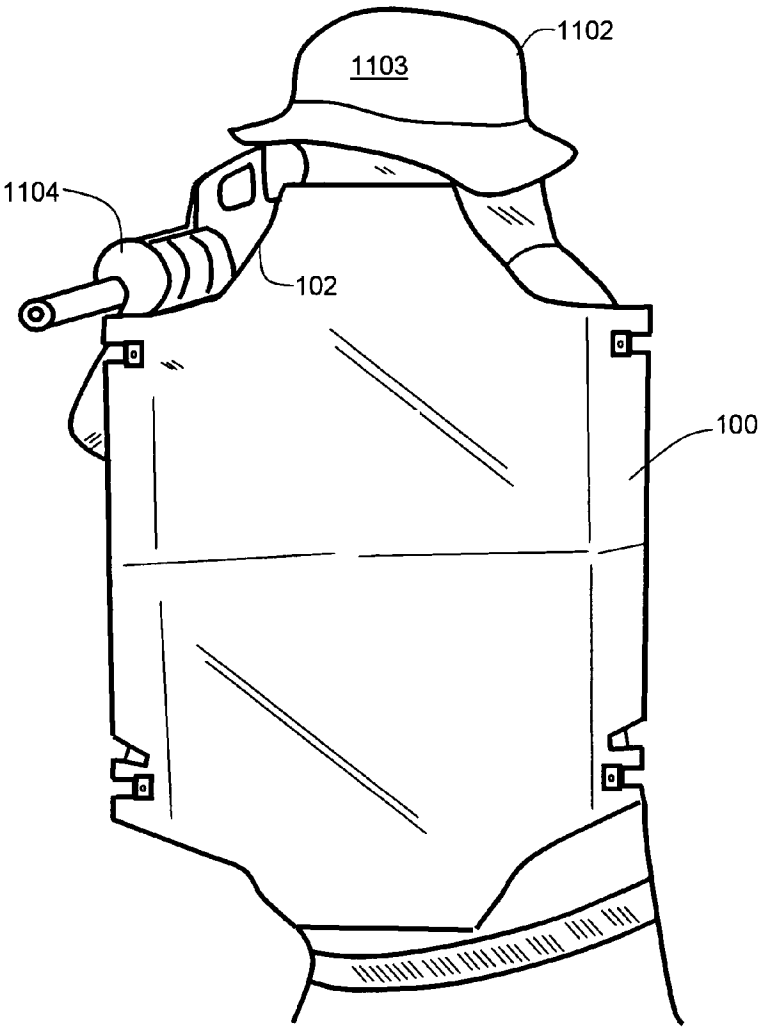
FIG. 12 shows a front view of an embodiment of a portable ballistic shield in use.

FIG. 12 shows a front view of an embodiment of a portable ballistic shield 100 in use. The firearm 1104 is supported by the ballistic shield, resting on cutaway 102. A curved profile of cutaway 102 is well-suited to receive the round barrel of firearm 1104. The shape of ballistic shield 100 allows for a small gap between the bottom of helmet 1103, and the top of the ballistic shield 100. The small gap is useful for providing protection for the user, while still allowing the user to identify an enemy target, and operate the firearm 1104.

Figure 13:
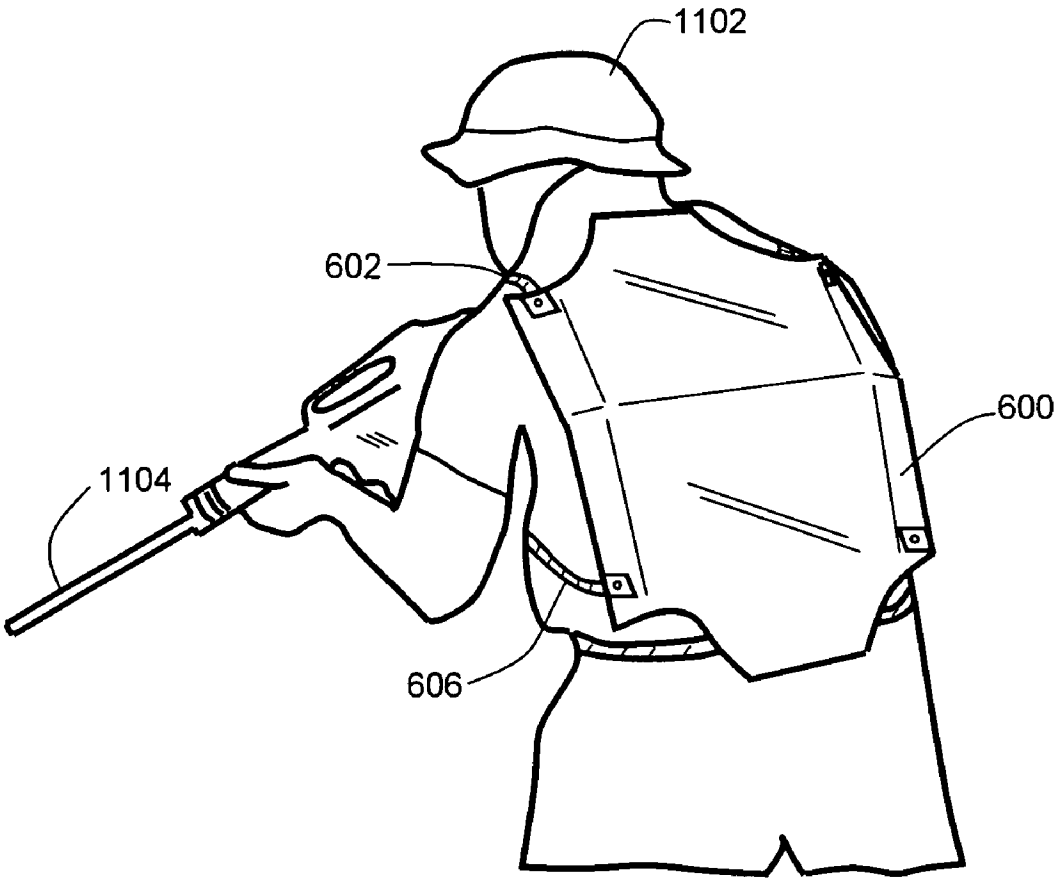
FIG. 13 shows a view of an embodiment of a portable ballistic shield in transport.

FIG. 13 shows a view of an embodiment of a portable ballistic shield 600 in transport. In this case, the user 1102 is wearing the ballistic shield 600 in a "cross-strap" configuration (see FIG. 6B). In this case, upper carry strap 602 is fastened to lower carry strap 608, and upper carry strap 605 is fastened to lower carry strap 606. The carry straps are fastened in the front (chest area) of user 1102, and the ballistic shield 600 is held in place on the user's back. This configuration is useful for a light patrol, where the user is not carrying a rucksack. The user 1102 can quickly remove the ballistic shield 600 from his back (by unhooking buckles 604 and 608

(see FIG. 6)) and get in a ready position, such as that shown in FIG. 12. While not in use, the ballistic shield 600 continues to provide protection on the user's back from enemy fire coming from behind. This configuration is also well suited to a "fast rope" operation, where a soldier is quickly scaling down a rope suspended from a helicopter, with the ballistic shield 600 worn in a cross-strap configuration, to keep the hands free for scaling down the rope.

Figure 14A:
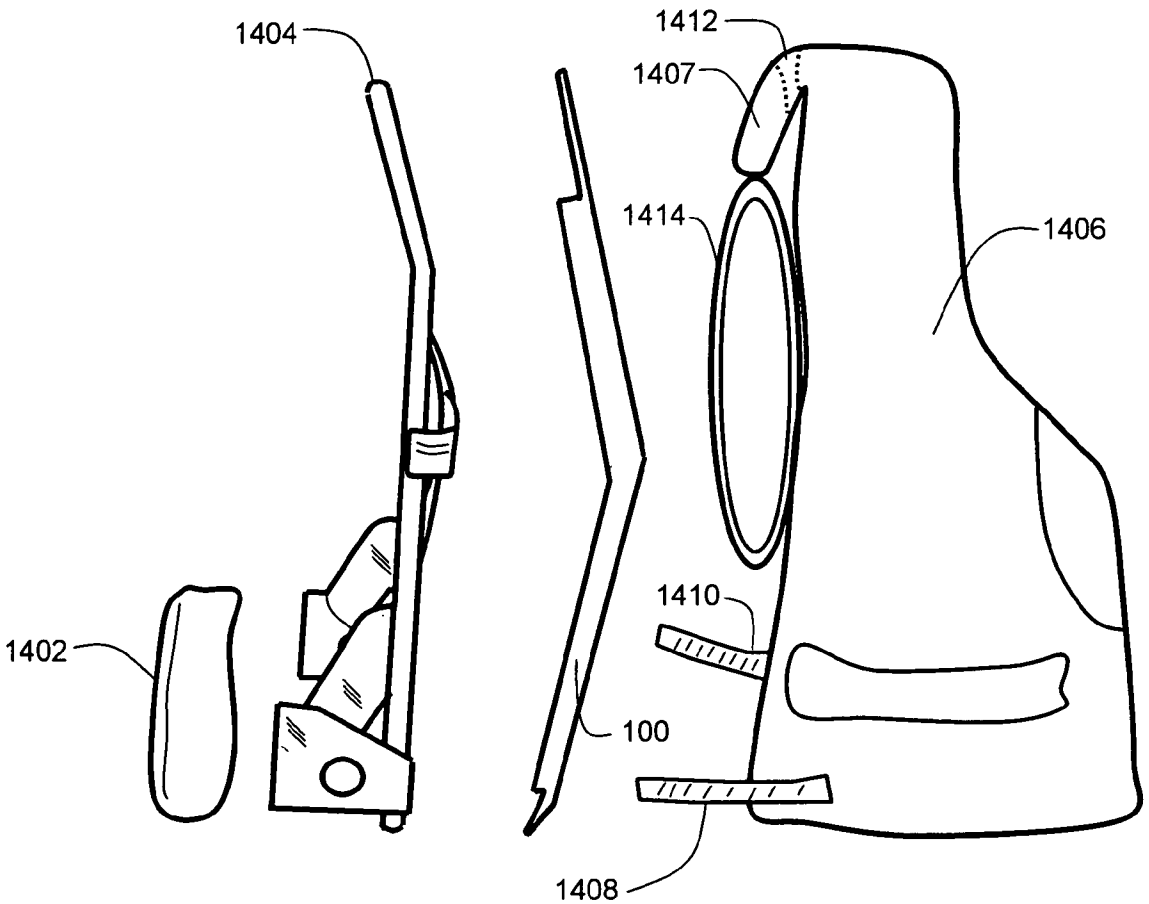
FIG. 14A shows an exploded view of an embodiment of a portable ballistic shield carried within a rucksack and frame.

FIG. 14A shows an exploded view of a kit using an embodiment of a portable ballistic shield 100 carried between a rucksack 1406 and frame 1404. A back pad 1402 mounts to frame 1404 to provide comfort and support for the wearer. The rucksack 1406 has lower straps 1408 and 1410 that may be used to secure ballistic shield 100 to frame 1404. The rucksack straps (1408, 1410) may traverse the openings (see 412 of FIG. 4) formed by cutouts 114 and 116 (see FIG. 1) and be secured to the frame, thereby holding the ballistic shield 100 securely in place between the frame 104 and rucksack 1406. The rucksack 1406 may have a top flap 1407 having an opening 1412 which the top of ballistic shield 100 may traverse, serving to secure the ballistic shield 100 at the top of rucksack 1406, while the straps 1408 and 1410 secure the ballistic shield 100 at the bottom of the rucksack. Shoulder straps 1414 are attached to rucksack 1406 to facilitate convenient carrying on a user's back.

Figure 14B:
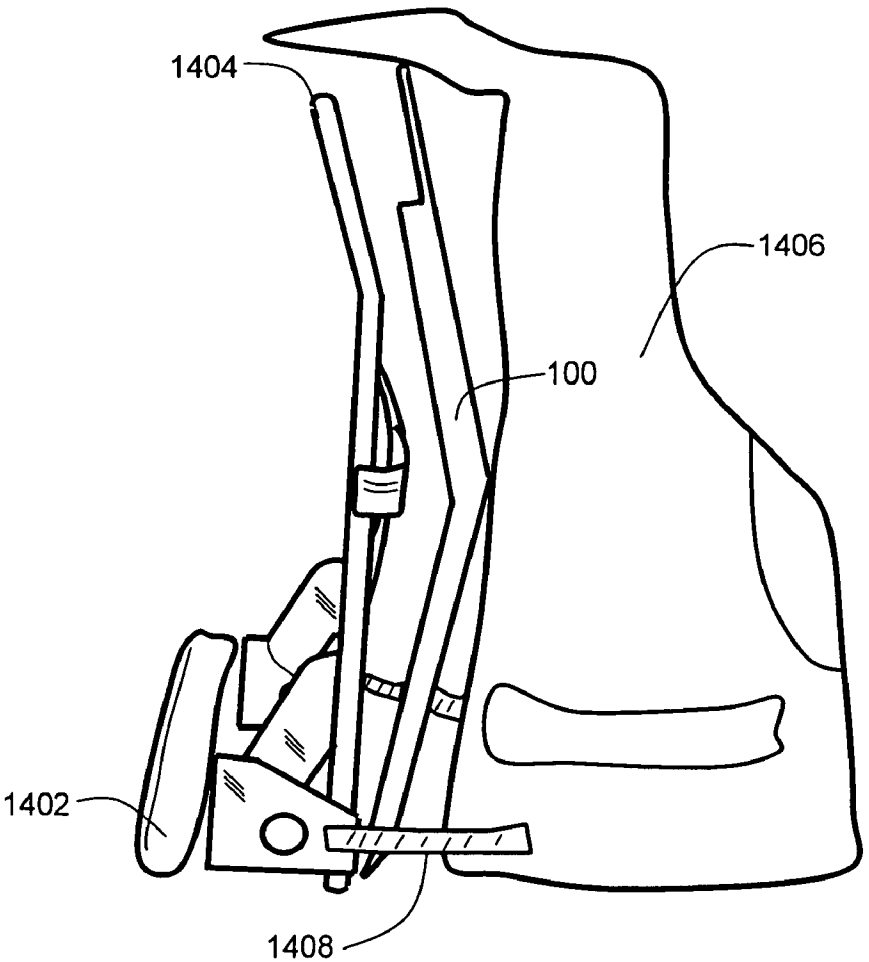
FIG. 14B shows a side view of an embodiment of a portable ballistic shield carried within a rucksack and frame.

FIG. 14B shows a side view of the embodiment of FIG. 14A with each element shown closer together, as is the case during transport. The portable ballistic shield 100 is carried between a rucksack 1406 and frame 1404. The back pad 1402 mounts to frame 1404 to provide comfort and support for the wearer. For the purpose of clearly showing other elements, the shoulder straps 1414 are not shown in this figure. This configuration is convenient for transporting a portable ballistic shield by a user on foot, such as a soldier.

Figure 15:
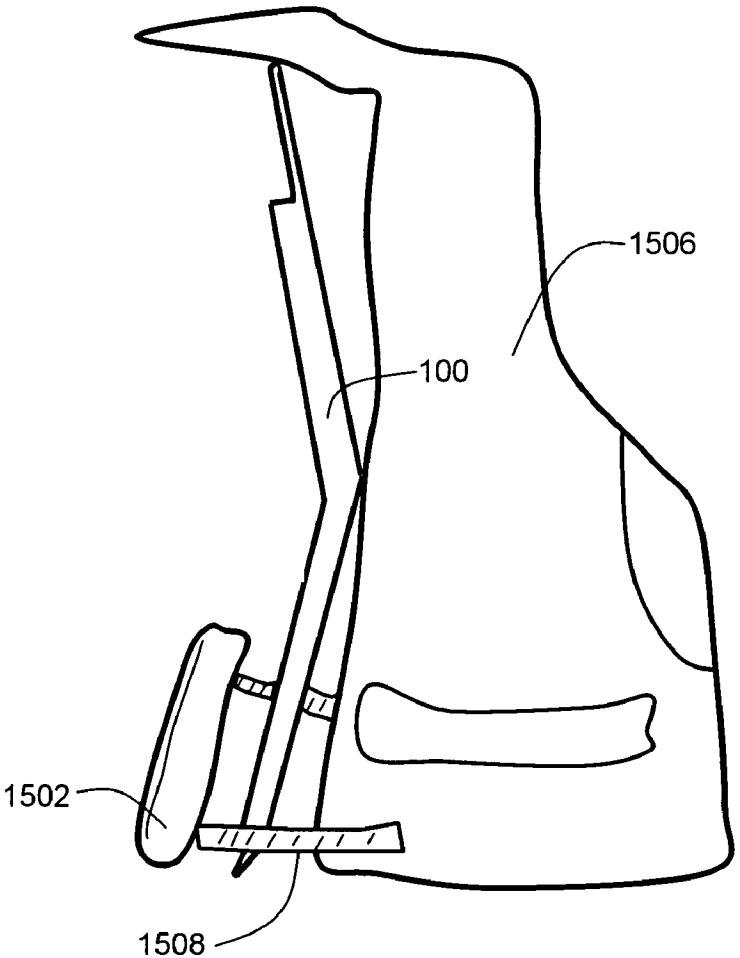
FIG. 15 shows a side view of an embodiment of a portable ballistic shield that also serves as a rucksack frame.

FIG. 15 shows a side view of an embodiment in which the ballistic shield 100 serves as the rucksack frame. Since ballistic shield 100 is rigid, it can serve as a rucksack frame, thereby eliminating the need for a separate rucksack frame (compare with 1404 of FIG. 14B).

Rucksack 1506 is similar to rucksack 1406 of FIG. 14B, except that the straps (1508) of rucksack 1506 are configured to secure back pad 1502, to provide comfort to the wearer. In this way, the bulkiness and weight of the frame (1404 of FIG. 14B) is eliminated, provided for a lighter pack, which enables a soldier to travel faster and or longer. For the purpose of clearly showing other elements, the shoulder straps 1414 are not shown in this figure.

Figure 16:
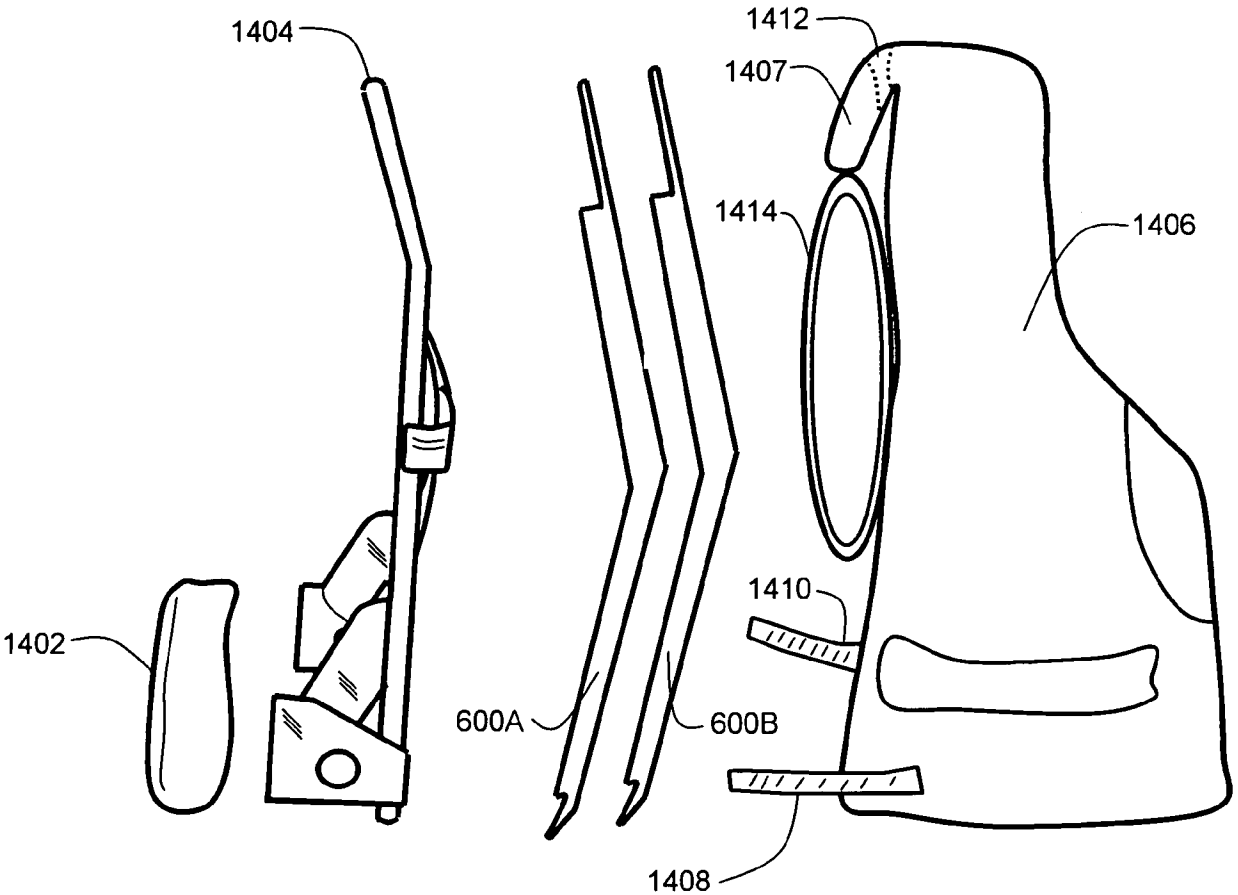
FIG. 16 shows an exploded view of an embodiment of two portable ballistic shields carried within a rucksack and frame.

FIG. 16 shows an exploded view of an embodiment of a kit with a second portable ballistic shield 600A disposed between the first portable ballistic 600B shield and the rucksack frame 1404. This figure is similar to FIG. 14A, except that two ballistic shields (600A and 600B) are used, as compared with the single ballistic shield shown in FIG. 14A. These shields are similar to that of shield 600 shown in FIG. 6A.

The unique shape of the portable ballistic shield allows for layering two ballistic shields to provide additional protection, while only minimally increasing the amount of space required. In this configuration, additional protection is provided by having two ballistic shields instead of one. When using the two shields in a defensive position such as that shown in FIG. 12, the two shields may be secured together via the carry straps (602, 605, 606, and 609 of FIG. 6), in which case, the carry straps of the outer shield are secured around the inner shield (the shield that is closer to the user). This configuration provides additional ballistic protection by the layering of two ballistic shields.

Embodiments of the present invention provide a portable ballistic shield has improved portability and maneuvering capabilities. It allows a user to fire a firearm while still getting the protection benefit of the shield. The portable ballistic shield can provide protection to soldiers or law enforcement officials at risk of enemy gunfire.

Although the description above contains many specific details, these should not be construed as limiting the scope of the invention, but merely as providing illustrations of some of the presently preferred embodiments of the present invention. The present invention may have various other embodiments. Furthermore, while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. Thus, the scope of the invention should be determined by the appended claims and their legal equivalents, rather than solely by the examples given.

What is claimed is:

1. A portable ballistic shield comprising a ballistic panel, the ballistic panel having a generally rectangular shape with two opposed upper cutaways, the ballistic panel further comprising an upper portion joined to a lower portion at an angle greater than zero degrees, wherein the portable ballistic shield has an inner side that faces a user, and an outer side that faces away from a user, the ballistic shield further comprising an arm strap affixed to the inner side of the ballistic shield in the lower left region of the ballistic shield, an arm strap affixed to the inner side of the ballistic shield in the lower right region of the ballistic shield, a handle affixed to the inner side of the ballistic shield in the upper left region of the ballistic shield, a handle affixed to the inner side of the ballistic shield in the upper right region of the ballistic shield, and a plurality of cutouts for receiving straps from a rucksack, wherein each of the plurality of cutouts comprises a strap brace disposed at an intermediate position in the cutout thereby creating an opening adapted to receive a strap of a rucksack.

2. The portable ballistic shield of claim 1, wherein the upper portion and lower portion are joined at an angle ranging from about 150 degrees to about 175 degrees.

3. The portable ballistic shield of claim 1, wherein the upper portion is comprised of a left, right, and center face, and the lower portion is comprised of a left, right, and center face.

4. The portable ballistic shield of claim 1, wherein each handle comprises an adjustment mechanism, whereby the handle may be adjusted to accommodate the hand of a specific user.

5. The portable ballistic shield of claim 1, wherein a cushion is affixed to the inner side of the shield.

6. The portable ballistic shield of claim 5, wherein the cushion is an X-shaped cushion.

7. The portable ballistic shield of claim 1, wherein each arm strap is mounted an angle ranging from about 20 degrees to about 50 degrees from vertical.

8. The portable ballistic shield of claim 1, further comprising at least one upper carry strap and at least one lower carry strap.

9. The portable ballistic shield of claim 8, comprising two upper carry straps and two lower carry straps, wherein the two upper carry straps are fastened together via a first mated buckle, and wherein the two upper carry straps are fastened together via a second mated buckle, wherein the first mated buckle is compatible with the second mated buckle, thereby allowing a cross-strap configuration.

10. The portable ballistic shield of claim 1, wherein each handle is mounted to the ballistic panel on a swivel fastener.

11. The portable ballistic shield of claim 10, wherein the ballistic panel is formed with a plurality of guide ridges, and wherein each swivel fastener is disposed between at least two guide ridges.

12. The portable ballistic shield of claim 1, wherein the strap brace is comprised of metal or composite material.

13. The portable ballistic shield of claim 1, wherein the two opposed upper cutaways have a curved profile.

14. The portable ballistic shield of claim 13, further comprising two opposed lower cutaways.

15. The portable ballistic shield of claim 14, wherein the ballistic panel is comprised of Dyneema.

16. A kit for conveniently transporting a portable ballistic shield by a user on foot, comprising:

A. A rucksack comprising:

(a) a plurality of lower straps attached to the rucksack at one side;

(b) a flap disposed at the top of the rucksack; and (c) an opening in the flap, the opening disposed to receive the upper portion of a ballistic shield;

B. a ballistic shield comprising:

a. a ballistic panel, the ballistic panel having a generally rectangular shape with two opposed upper cutaways;

b. a plurality of cutouts for receiving the lower straps from the rucksack, wherein each of the plurality of cutouts comprises a strap brace disposed at an intermediate position in the cutout, thereby creating an opening adapted to receive one of the lower straps of the rucksack; and c. wherein the ballistic panel further comprises an upper portion joined to a lower portion at an angle greater than zero degrees;

C. a rucksack frame; and

D. a back pad, the back pad mounted to said rucksack frame.

17. The kit of claim 16, further comprising a second portable ballistic shield disposed between the first portable ballistic shield and the rucksack frame.

18. A kit for conveniently transporting a portable ballistic shield by a user on foot, comprising:

A. a rucksack comprising:

(a) a plurality of lower straps attached to the rucksack;

(b) a flap disposed at the top of the rucksack; and (c) an opening in the flap, the opening disposed to receive the upper portion of a ballistic shield;

B. a ballistic shield comprising:

a. a ballistic panel, the ballistic panel having a generally rectangular shape with two opposed upper cutaways;

b. a plurality of cutouts for receiving the lower straps from the rucksack, wherein each of the plurality of cutouts comprises a strap brace disposed at an intermediate position in the cutout, thereby creating an opening adapted to receive one of the lower straps of the rucksack; and c. wherein the ballistic panel further comprises an upper portion joined to a lower portion at an angle greater than zero degrees;

C. a back pad, the back pad secured against the ballistic shield by the plurality of lower straps attached to the rucksack, whereby the ballistic shield also serves as a rucksack frame, thereby eliminating the need for a separate rucksack frame.

* * * * *